US008042204B2

(12) United States Patent
Kavounas

(10) Patent No.: US 8,042,204 B2
(45) Date of Patent: Oct. 25, 2011

(54) EQUIPPING BABY CRIB WITH SNACK BOX FOR OVERNIGHT STORAGE

(76) Inventor: Gregory T. Kavounas, Kirkland, WA (US)

( * ) Notice: Subject to any disclaimer, the term of this patent is extended or adjusted under 35 U.S.C. 154(b) by 1524 days.

(21) Appl. No.: 11/248,929

(22) Filed: Oct. 11, 2005

(65) Prior Publication Data

US 2006/0026756 A1 Feb. 9, 2006

Related U.S. Application Data

(63) Continuation-in-part of application No. 10/740,117, filed on Dec. 17, 2003, now abandoned.

(51) Int. Cl.
*A47D 7/00* (2006.01)
*A47D 13/06* (2006.01)
*A47D 15/00* (2006.01)

(52) U.S. Cl. ..... 5/93.1; 62/261

(58) Field of Classification Search ..... 5/93.1, 5/284, 421; 62/239, 244, 259.1, 261, 263; 280/47.38; 312/236
See application file for complete search history.

(56) References Cited

U.S. PATENT DOCUMENTS 2,358,071 A * 9/1944 Hurtado ..... 312/236
2,525,952 A * 10/1950 Saterlie et al. ..... 312/236
3,808,607 A * 5/1974 Harder ..... 4/545
4,378,140 A * 3/1983 McKee ..... 439/371
4,545,211 A * 10/1985 Gaus ..... 62/115
4,637,222 A * 1/1987 Fujiwara et al. ..... 62/244
4,707,684 A * 11/1987 Janke et al. ..... 340/530
4,719,764 A * 1/1988 Cook ..... 62/261
4,765,151 A * 8/1988 Bessey ..... 62/239
4,779,923 A * 10/1988 Lang et al. ..... 312/235.2
4,912,942 A * 4/1990 Katterhenry et al. ..... 62/338
5,054,136 A * 10/1991 Inagaki ..... 4/546
5,315,084 A * 5/1994 Jensen ..... 219/689
6,106,058 A * 8/2000 Sur et al. ..... 297/188.19
6,200,155 B1 * 3/2001 Chudkosky et al. ..... 439/371
6,276,753 B1 * 8/2001 Sur et al. ..... 297/188.19
2002/0093157 A1 * 7/2002 Turner et al. ..... 280/47.25
2002/0093158 A1 * 7/2002 Turner et al. ..... 280/47.35
2002/0093159 A1 * 7/2002 Turner et al. ..... 280/47.35
2002/0093160 A1 * 7/2002 Mendenhall ..... 280/47.38
2002/0109321 A1 * 8/2002 Turner et al. ..... 280/47.38
2005/0132491 A1 * 6/2005 Kavounas ..... 5/93.1
2006/0026756 A1 * 2/2006 Kavounas ..... 5/99.1

* cited by examiner

*Primary Examiner* — Robert G Santos

(57) ABSTRACT

Kits, devices, and methods are provided for attaching a snack box to a crib. Attached is such that, while still in the crib, the infant can open the lid and retrieve a snack stored inside, such as a bottle of milk. In some embodiments the snack box can even accommodate cold storage, e.g. by having a thermally insulated enclosure. It can even be a small electric refrigerator. Before the parent goes to sleep for the night, they can prepare a snack, and store it overnight in the snack box. When the infant wakes up in the morning, they can retrieve the snack by themselves, after a few days' training, without crying. This will permit the parent to sleep longer, because they will not have to wake up prematurely for delivering the morning snack, and then wait until it is consumed.

23 Claims, 2 Drawing Sheets

EQUIPPING BABY CRIB WITH SNACK BOX FOR OVERNIGHT STORAGE

RELATIONSHIP TO OTHER APPLICATIONS

This is a continuation-in-part of application Ser. No. 10/740,117 titled EQUIPPING BABY CRIBS WITH REFRIGERATORS, which was filed Dec. 17, 2003 now abandoned, which application is incorporated by reference herein in its entirety for all purposes.

FIELD OF THE INVENTION

The present invention is related to the field of indoors furniture, and more specifically to baby cribs, kits and devices for cribs to be equipped with a snack box for overnight storage of a snack such as milk, to be readily available to them when they wake up.

BACKGROUND

Infants frequently sleep during the night in cribs. A crib is a piece of indoor furniture, usually placed in either the parent's bedroom or a nursery.

When the infant wakes up in the morning, it tends to cry until given a snack, such as a bottle of milk. A parent needs to wake up to prepare it, sometimes before they were ready to wake up.

For somewhat older infants, parents often prepare the milk in the evening before, and store it in the family refrigerator, which is typically in the kitchen. When in the next morning they hear the infant cry, they go to the kitchen, pick up the bottle from the family refrigerator, and then go deliver it to the infant.

In some instances that is not enough, and the infant needs attention additional to the snack. But most of the times, the infant is content merely to get the snack, and start eating. In those instances, some parents may return to bed. After taking the time to consume the snack, the infant will cry again, waking up the parent again.

BRIEF DESCRIPTION OF THE DRAWINGS

The invention will become more readily apparent from the following Detailed Description, which proceeds with reference to the accompanying drawings, in which.

DETAILED DESCRIPTION

Briefly, the present invention provides kits, devices, and methods for equipping a baby crib with a snack box, and using it. The snack box is attached to the crib, and oriented such that the infant can open its lid while still being in the crib. This way the infant can access a snack stored inside the snack box, such as a bottle of milk. In some embodiments the snack box can even accommodate cold storage, e.g. by having a thermally insulated enclosure. It can even be a small electric refrigerator. In the evening, before the parent goes to sleep for the night, they can prepare a snack, and store it overnight in the snack box. When the infant wakes up in the morning, they can open a lid of the snack box and retrieve the snack by themselves, after a few days' training. And if the infant needs no attention beyond the snack, it might not cry at the moment of waking up or while eating. This will permits the parent to sleep longer, because they will not have to wake up prematurely for delivering the morning snack, and wait until it is consumed. That is especially valuable for days that the parents do not have to get up early to go to work The invention is now described in more detail.

The invention may be sold in kits. In some embodiments, a kit is an assembly kit for a full crib that is equipped with a snack box as described. In other embodiments, the kit is merely for retrofitting a crib with a snack box.

Figure 1:
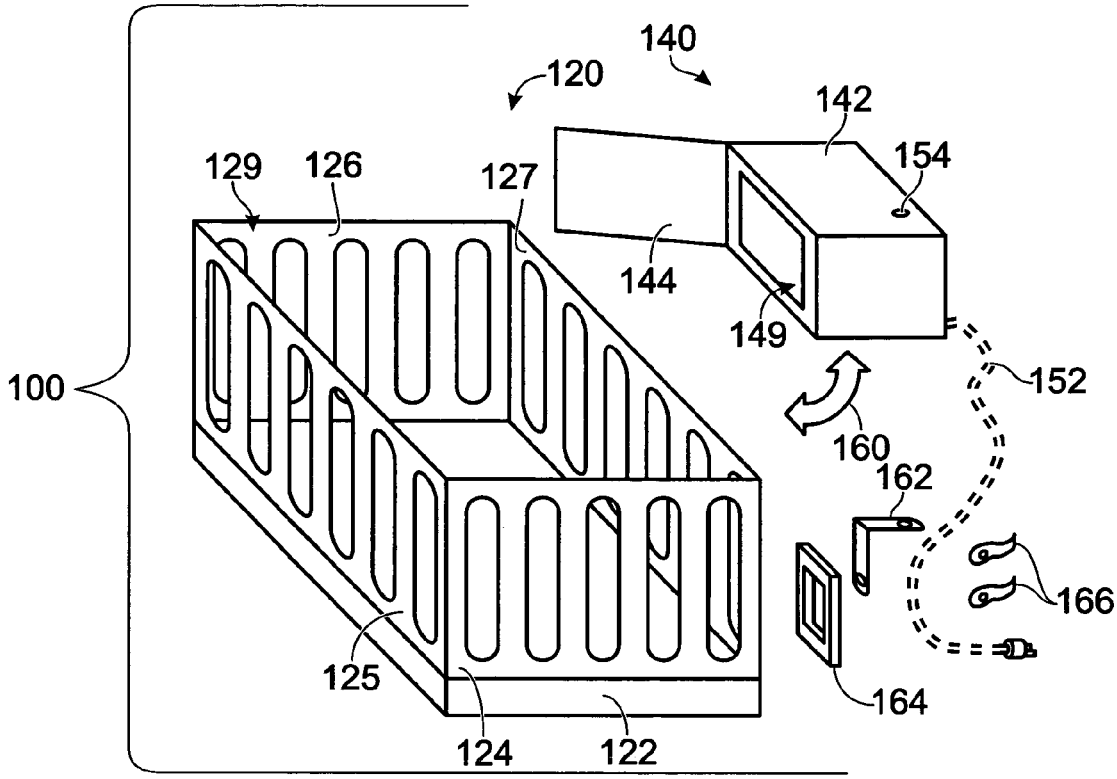
FIG. 1 is a diagram of components for describing kits according to embodiments of the invention.

FIG. 1 is a diagram of components for describing kits according to embodiments of the invention. More particularly, FIG. 1 shows components of assembly kit 100 of a baby crib with a snack box. Kit 100 includes crib components denoted generally by arrow 120, and snack box 140. The crib components include crib base 122, and side walls 124, 125, 126, 127 intended for attaching substantially vertically with respect to base 122. In FIG. 1, these components are shown as already assembled, as may be known without a snack box, and together form a space 129 suitable for an infant to sleep in, which is also known as sleeping space 129.

Snack box 140 includes an enclosure 142 that defines an interior 149, where the snack is to be placed. Snack box 140 also includes a lid 144 that can open to expose interior 149. Lid 144 preferably has a drawing or toy shape on it, to focus the infant's attention.

Snack box 140 may be any suitable size. In order to fit a milk cup, interior 149 need be no larger than one cubic foot (0.027 $m^3$). In any event, snack box 140 can have an interior capacity of up to 4 cubic feet (0.108 $m^3$).

In some embodiments, enclosure 142 is intended to maintain the temperature of the snack while storing it overnight. For example, enclosure 142 can be made also from thermally insulating material. This way an initially hot item can be maintained somewhat hot, and an initially cold item can be maintained somewhat cold, especially if stored with a cold item.

In some of those embodiments, snack box 140 is an electric refrigerator, preferably around the dimensions mentioned above. When snack box 140 is an electric refrigerator, it can have a power cord 152 for plugging into a wall outlet for power. Refrigerator 140 can also include an ON indicator light 154, which comes on when power cord 152 is plugged in. This way interior 149 will be maintained at a cool temperature overnight.

Snack box 140 is intended for attachment to crib components 120, as suggested by general arrow 160. Attachment may be by a fastener, such as bracket 162, a flange, and the like.

Kit 100 additionally includes incidentals for completing the above described attachments for the assembly, such as screws, nuts, bolts and the like that are typically provide with such kits, as will be discerned by a person skilled in the art. Furthermore, tools such as a screwdriver may further be provided in the kit.

In addition, if snack box 140 is implemented as an electric refrigerator, a damper 164 may be optionally provided, to provide vibration isolation between the refrigerator and one of the crib walls. Damper 164 can be made from sound insulating material, and further shaped according to its eventual application. Moreover, at least one cord fastener may be provided. In the embodiment of FIG. 1, cord fasteners 166 are for attaching at least a segment of power cord 152 to one of the side walls.

Further, FIG. 1 shows components of a retrofitting kit according to the invention. These are components of kit 100, without crib components 120.

Once kit 100 is fully assembled, or retrofitting has been accomplished, the result is largely as described above. The assembled device has crib base 100, and side walls 124, 125, 126, 127 attached to base 100 so as to form space 129 suitable for an infant to sleep in. Snack box 140 is attached to one of the walls, optionally and preferably through damper 164. If snack box 140 is implemented as an electric refrigerator, a segment of power cord 152 can be attached to one or two of side walls 124, 125, 126, 127 via fasteners 166.

An infant in sleeping space 129 can access snack box 140 after waking up. In other words, the orientation of the finally assembled components is configured such that, while in sleeping space 129, the infant can access both lid 144 for opening it, and interior 149 for retrieving the snack. Once they learn to do that, they may do with without crying, and therefore permitting the parent to sleep longer.

Assembly or retrofitting can be in a number of configurations. Various possibilities are now described.

Snack box 140 can be attached on one or two adjoining ones of the sidewalls of the crib. If on a single one, it can be near one of its ends, or somewhere in the middle.

Figure 2A:
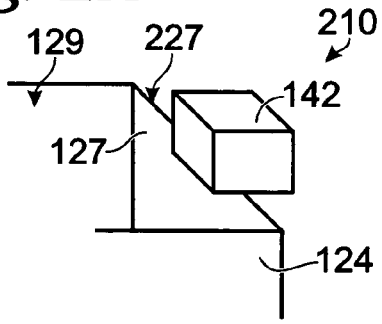
FIGS. 2A, 2B, 2C are perspective diagrams showing configurations of how a snack box can be attached to a crib wall.
Figure 2B:
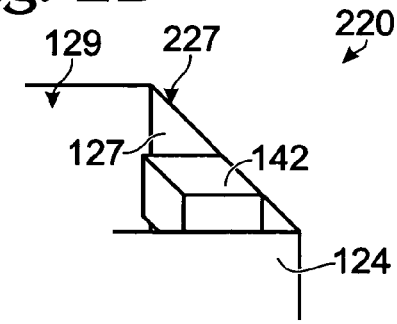
Figure 2C:
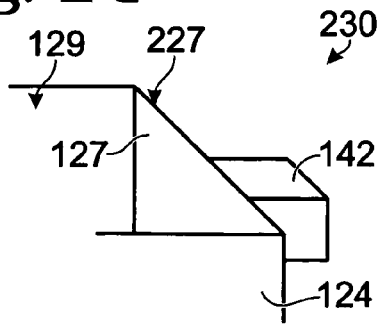

FIGS. 2A, 2B, 2C are perspective diagrams showing respectively configurations 210, 220, 230 of attaching snack box 140 to at least wall 127. In all of them, the snack box is shown attached such that its enclosure 142 is near the middle of wall 127. Of course, that is not limiting, and attachment at an end of rim 227 is also possible.

FIG. 2A shows configuration 210, where enclosure 142 of the snack box is attached on top of rim 227 of side wall 127.

FIG. 2B shows configuration 220, where enclosure 142 of the snack box is attached on the side of side wall 127, within sleeping space 129. In configuration 220, it is preferred to attach snack box 140 near top rim 227 of side wall 127. This way, the infant cannot use snack box 140 to climb out of the crib.

FIG. 2C shows configuration 230, where enclosure 142 of the snack box is attached on the side of side wall 127, but outside sleeping space 129. This is preferred for the retrofitting embodiments, where an existing crib wall will be used for attachment with minimum adjustments.

In general, in all of configurations 210, 220, 230, there is no limitation as to which side of enclosure 142 includes lid 144. Indeed, enclosure 142 and its attachment may be designed so that lid 144 may be located at any of the sides, or even the top. In the case of configuration 230, the preferred embodiment is with opening from the top.

Figure 3A:
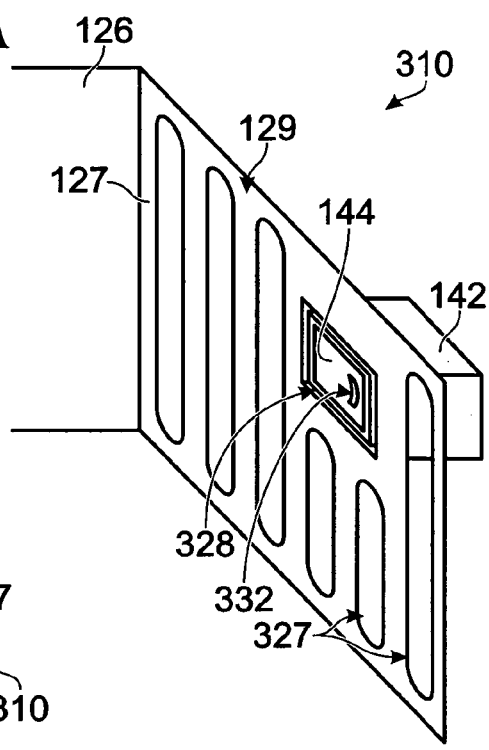
FIGS. 3A, 3B are front and back perspective diagrams respectively, for showing an implementation according to the configuration of FIG. 2C.
Figure 3B:
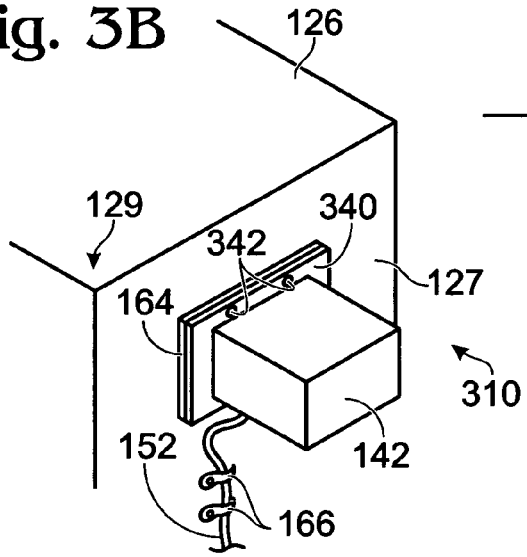
Figure 4A:
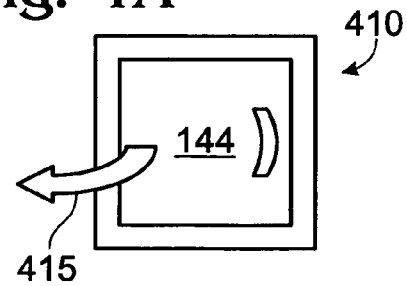
FIGS. 4A, 4B, 4C, 4D show various configurations of how a lid of the snack box can open with respect to the enclosure, when in the configuration of FIG. 3A.
Figure 4B:
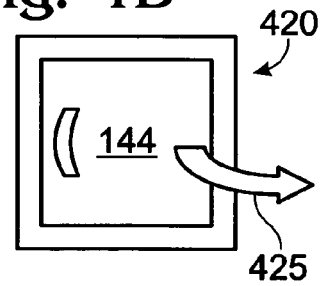
Figure 4C:
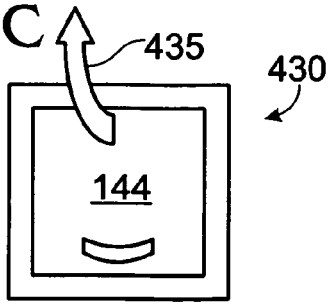
Figure 4D:
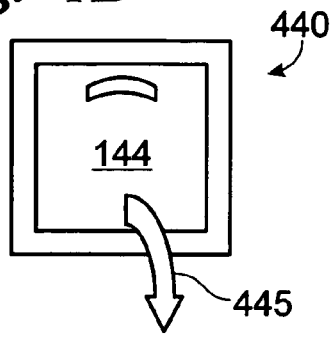

FIGS. 3A, 3B are front and back perspective diagrams respectively, for showing an implementation 310 according to configuration 230 of FIG. 2C. Even though the snack box is located such that its enclosure 142 outside sleeping space 129, side wall 127 has access opening 328 shaped such that lid 144 can open through opening 328. This way the snack can be accessed from inside the crib, by opening handle 332 of lid 144. Handle 332 can be shaped as a toy, to draw an infant's attention.

It is interesting how access opening 328 is different from view openings 327 of wall 127. View openings 327 are constricted, such that a rigid ball having a diameter of at least some size cannot pass through them. On the contrary, access opening 328 is shaped such that the same ball could pass through in some instances. It should be noted that, while opening 328 is in itself wide, the infant cannot go through it because the snack box would be in the way.

Referring particularly to FIG. 3B, enclosure 142 of the snack box is attached to wall 127 via a flange 340 that is bolted to wall 127 via bolts 342. Damper 164 is provided between flange 340 and side wall 127, and is shaped like a window to allow lid 144 through for opening. Further, cord fasteners 166 attach a segment of power cord 152 to wall 127, so that it attracts less attention.

FIGS. 4A, 4B, 4C, 4D show respectively configurations 410, 420, 430, 440 of how lid 144 can open with respect to the enclosure, from the point of view of the infant, when in configuration 310 of FIG. 3A. Lid 144 can open sideways to the left (arrow 415), to the right (arrow 425), upwards (arrow 435), or downwards (arrow 445). The preferred embodiment is configuration 430, where the upward opening lid 144 closes again under its own weight. Other configurations are also possible.

Methods according to the invention are now described.

A method according to the invention is for an adult, such as a parent. According to the method, before going to bed at night, the adult places an infant to sleep in a crib for the night, such as one made from components 100. The adult also prepares a snack for when the infant will wake up in the morning after the night, and places the snack in a snack box that is attached to the crib, such as snack box 140. Then the adult goes to sleep for the night, e.g. in their own bed.

The snack may be a bottle of milk. It is preferred to wait until the infant falls asleep, prior to placing. It is preferred that placing is at night.

In some embodiments, the snack box is an electric refrigerator. In some of those embodiments, it is preferred to check that an ON indicator light of the refrigerator is lit, in connection with placing. This would ensure that the refrigerator is working properly, and thus the snack will not spoil while the infant is sleeping.

When the child wakes up the first few mornings the invention is used, they will not know that the snack is so accessible to them. So, they will cry as in the other times. The parent should walk over to the snack box, and draw the infant's attention to it. Then the lid should be opened, and the snack retrieved and delivered. With a few repetitions, a child will learn to directly check the snack box in the morning for milk, sometimes without crying.

Another method according to the invention is for an infant to wake up in the sleeping space of a crib, and to open the lid of a snack box that is attached to the crib without leaving the crib. Then a snack is retrieved from the interior of the snack box.

While the present invention is disclosed in its preferred form, the specific embodiments of the invention as disclosed herein and illustrated in the drawings are not to be considered in a limiting sense. Rather, these embodiments are provided so that this disclosure will be thorough and complete, and will fully convey the scope of the invention to those skilled in the art. Indeed, it should be readily apparent in view of the present description that the invention may be modified in numerous ways. The detailed description is, therefore, not to be taken in a limiting sense.

Throughout the specification, the meaning of "a," "an," and "the" may also include plural references. The meaning of "in" includes "in" and "on." The term "coupled" means a direct connection between the items that are connected, or an indirect connection through one or more intermediary devices or components.

Numerous details have been set forth in this description, which is to be taken as a whole, to provide a more thorough understanding of the invention. In other instances, well-known features have not been described in detail, so as to not obscure unnecessarily the invention.

The invention includes combinations and subcombinations of the various elements, features, functions and/or properties disclosed herein. The following claims define certain combinations and subcombinations, which are regarded as novel and non-obvious. Additional claims for other combinations and subcombinations of features, functions, elements and/or properties may be presented in this or a related document.

The invention claimed is:

1. An assembly kit for an indoor crib suitable for an infant to sleep in, comprising:

a crib base extending horizontally for supporting a child;

a plurality of side walls for attaching substantially vertically with respect to and extending upwardly from the crib base so as to form a sleeping space suitable for the infant to sleep in; and a snack box for attaching to at least one of the side walls at a position above the crib base and having an enclosure that defines an interior and a lid openable to expose the interior, the lid and the interior accessible to the infant while in the sleeping space.

2. The kit of claim 1, wherein the enclosure is made also from thermally insulating material.

3. The kit of claim 1, further comprising:

at least one fastener to attach the snack box to at least one of the side walls.

4. The kit of claim 1, wherein one of the side walls has an access opening shaped such that the lid can open through it.

5. The kit of claim 1, wherein the snack box is an electric refrigerator.

6. The kit of claim 5, further comprising:

a damper to provide vibration isolation between the refrigerator and one of the crib walls.

7. The kit of claim 5, further comprising:

a cord fastener to attach to one of the side walls a segment of a power cord of the refrigerator.

8. A retrofitting kit for an indoors crib having a crib base extending horizontally for supporting a child and a plurality of side walls attached substantially vertically to and extending upwardly from the crib base so as to form a sleeping space suitable for an infant to sleep in, the kit comprising:

a snack box having an enclosure that defines an interior and a lid openable to expose the interior; and at least one fastener to attach the snack box to at least one of the side walls at a position above the crib base such that the lid and the interior are accessible to the infant while in the sleeping space.

9. The kit of claim 8, wherein the enclosure is made also from thermally insulating material.

10. The kit of claim 8, wherein the snack box is to be attached such that the lid opens from its top side.

11. The kit of claim 8, wherein the snack box is an electric refrigerator.

12. The kit of claim 11, further comprising:

a damper to provide vibration isolation between the refrigerator and one of the crib walls.

13. The kit of claim 11, further comprising:

a cord fastener to attach to one of the side walls a segment of a power cord of the refrigerator.

14. An indoors crib suitable for an infant to sleep in, comprising:

a crib base extending horizontally for supporting a child;

a plurality of side walls attached to and extending upwardly from the crib base so as to form a sleeping space suitable for the infant to sleep in; and a snack box having an enclosure that defines an interior and a lid openable to expose the interior, the snack box attached to at least one of the side walls at a position above the crib base so that the lid and the interior are accessible to the infant while in the sleeping space.

15. The crib of claim 14, wherein the enclosure is made also from thermally insulating material.

16. The crib of claim 14, wherein one of the side walls has an access opening shaped such that the lid can open through it.

17. The crib of claim 14, wherein the snack box is attached near a top rim of the side wall.

18. The crib of claim 14, wherein the snack box is an electric refrigerator.

19. The crib of claim 18, further comprising:

a damper between the crib wall and the refrigerator.

20. The crib of claim 18, further comprising:

a cord fastener attaching to one of the side walls a segment of a power cord of the refrigerator.

21. A method comprising:

before going to bed at night, placing an infant in a crib having a base and side walls extending upwardly from the base to sleep for the night, preparing a snack for when the infant will wake up from sleeping in the morning after the night, and placing the snack in a snack box that is attached to one of the side walls of the crib at a position above the base; and then going to sleep for the night.

22. The method of claim 21, wherein the snack box is an electric refrigerator, and further comprising checking an ON indicator light of the refrigerator in connection with placing.

23. A method for an infant comprising:

the infant waking up in a sleeping space formed by a horizontally extending base and sidewalls extending upwardly from the base of an indoors crib; and without leaving the sleeping space, the infant then opening a lid of a snack box attached to one of the sidewalls of the crib at a position above the base and retrieving a snack stored in an interior of the snack box.

* * * * *